US010556163B2

(12) United States Patent
Kim

(10) Patent No.: US 10,556,163 B2
(45) Date of Patent: Feb. 11, 2020

(54) GRIP FOR GOLF CLUB

(71) Applicant: Kyong Ho Kim, Seoul (KR)

(72) Inventor: Kyong Ho Kim, Seoul (KR)

(73) Assignee: Kyong Ho Kim, Seoul (KR)

( * ) Notice: Subject to any disclaimer, the term of this patent is extended or adjusted under 35 U.S.C. 154(b) by 0 days.

(21) Appl. No.: 16/339,803

(22) PCT Filed: Oct. 12, 2017

(86) PCT No.: PCT/KR2017/011235
§ 371 (c)(1),
(2) Date: Apr. 5, 2019

(87) PCT Pub. No.: WO2018/074774
PCT Pub. Date: Apr. 26, 2018

(65) Prior Publication Data

US 2019/0308080 A1 Oct. 10, 2019

(30) Foreign Application Priority Data

Oct. 20, 2016 (KR) ..... 10-2016-0136591

(51) Int. Cl.
*A63B 53/14* (2015.01)
*A63B 60/14* (2015.01)
*A63B 60/10* (2015.01)

(52) U.S. Cl.
CPC ..... *A63B 60/14* (2015.10); *A63B 53/14* (2013.01); *A63B 60/10* (2015.10)

(58) Field of Classification Search
CPC ..... A63B 60/14; A63B 53/14; A63B 60/10
See application file for complete search history.

(56) References Cited

U.S. PATENT DOCUMENTS 2,103,889 A * 12/1937 Brisick ..... A63B 53/14 473/303
D128,266 S * 7/1941 Smith ..... D21/756
5,653,643 A * 8/1997 Falone ..... A63B 53/14 473/300
D417,895 S * 12/1999 Kim ..... D21/756
7,798,911 B2 * 9/2010 Gill ..... A01K 87/08 473/297
2008/0032832 A1 * 2/2008 Thomas ..... A63B 49/08 473/549

(Continued)

FOREIGN PATENT DOCUMENTS

CN 2486186 Y 4/2002
CN 201500420 U 6/2010

(Continued)

OTHER PUBLICATIONS

International Search Report for PCT/KR2017/011235 dated Jan. 29, 2018.

*Primary Examiner* — Stephen L Blau
(74) *Attorney, Agent, or Firm* — The PL Law Group, PLLC

(57) ABSTRACT

A grip for a golf club includes a concave part in which thumbs of the user are placed or inserted when the user grips the grip, at least one guide member provided on an inner surface of the concave part to guide positions and a gripping order of the thumbs of the user, and at least one anti-slip element provided on the inner surface of the concave part to prevent the thumbs from slipping.

11 Claims, 5 Drawing Sheets

(56) References Cited

U.S. PATENT DOCUMENTS

| | | | | |
|---|---|---|---|---|
| 2008/0227562 | A1* | 9/2008 | Gill | A01K 87/08 473/299 |
| 2011/0098126 | A1* | 4/2011 | Johnson | A63B 53/14 473/300 |
| 2011/0172024 | A1* | 7/2011 | Lu | A63B 49/08 473/300 |
| 2011/0300965 | A1* | 12/2011 | Gill | A63B 53/14 473/299 |
| 2011/0300966 | A1* | 12/2011 | Gill | A63B 53/14 473/299 |
| 2012/0060879 | A1* | 3/2012 | Webb | B63H 16/04 135/72 |
| 2013/0072320 | A1* | 3/2013 | Chu | A63B 53/14 473/298 |
| 2013/0130825 | A1* | 5/2013 | McLoughlin | A63B 60/34 473/303 |
| 2013/0203514 | A1* | 8/2013 | Chu | A63B 53/14 473/203 |
| 2018/0078836 | A1* | 3/2018 | Davis | A63B 60/14 |
| 2019/0275395 | A1* | 9/2019 | Davis | A63B 60/08 |

FOREIGN PATENT DOCUMENTS

| | | | |
|---|---|---|---|
| JP | 2011-030938 | A | 2/2011 |
| JP | 2015-073607 | A | 4/2015 |
| KR | 10-2010-0133799 | A | 1/2010 |

* cited by examiner

GRIP FOR GOLF CLUB

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2017/011235, filed Oct. 12, 2017, which claims priority to the benefit of Korean Patent Application No. 10-2016-0136591 filed in the Korean Intellectual Property Office on Oct. 20, 2016, the entire contents of which are incorporated herein by reference.

TECHNICAL FIELD

The present invention relates to a grip for a golf club and, more particularly, to a grip for a golf club in which the structure of the grip is improved to provide stable grip for a user, whereby accuracy of the grip is improved and a driving distance thereof is increased when the user swings.

BACKGROUND ART

Generally, golf is a sport where a player tries to put a golf ball into a hole by hitting the ball with a golf club. Various golf clubs are used in consideration of a position from which the golf ball is hit, a hitting direction, and a fly distance.

The golf club includes a putter, an iron, and a wood, etc. These golf clubs are commonly configured of a grip functioning as a handle, a shaft, and a head. The head is a part for hitting the golf ball directly and is provided obliquely at a lower part of the golf club. The shaft is a long part of the golf club and is provided with the head at a first end and the grip at a second end. The grip is an end of the shaft and is provided for being gripped and swung by a user.

The putter is a golf club in which a hitting surface of a head thereof is perpendicular to perform putting on a green, and the iron is a golf club having a head and a shaft shorter than a head and a shaft of the wood and is used to perform middle and short distance strokes. The wood is a golf club having a long shaft and is used to perform a long distance shot, especially, a tee-off shot. The wood was originally made of wood, but recently it is made of a metal material.

As shown in FIG. 1, the golf club includes the shaft 100 having a predetermined length and made of metal or graphite, that is, carbon graphite made of carbon fiber. The head 300 is provided at a front end part of the shaft 100 and hits the golf ball, and the grip 500 is provided at a rear end part of the shaft 100 and is provided to be held by a user's hand.

Here, the grip 500 may have a cylindrical shape or a tapered shape in which a diameter of a rear half part is provided larger than a diameter of a front half, and may be formed of various materials such as rubber, leather, and synthetic resin materials.

The grip 500 is provided for the user to grip and swing the golf club, so the grip 500 should be firmly in close contact with the hand of the user. Accordingly, the grip 500 should be provided so that fingers and the palm of the user are prevented from slipping as much as, and the user's wrist is not twisted. However, in case of using a conventional and general golf club, when a force is applied to the golf club while the user hits the golf ball, the hand of the user slips or positions of the fingers change, whereby it is difficult to obtain a desired driving distance or hitting direction.

In general, among methods to hold the grip 500, a palm grip is a gripping method of unfolding a palm of a left hand while putting all fingers of the left hand together and folding a second segment of an index finger and a middle of the palm with a diagonal line so that the second segment and a tip of a thumb have the same length, and gripping the grip 500 so that it crosses the palm with the diagonal line. In this case, the grip 500 has a wider ground plane. In addition, in the palm grip state described above, the grip 500 is placed on second segments of a middle finger and a ring finger of the right hand, and is gripped such that a tip of the thumb and a second segment of an index finger of the right hand have approximately the same length. When the palm grip is performed as described above, the golf club is not twisted even when the grip is lightly gipped, and proper cocking is performed depending on a swing size. As swinging is performed with the palm grip, the golf club moves along an orbit of a left arm, and a width of a swing arc increases automatically.

However, when the front half part of the grip 500 is supported by the thumb and index finger of the right hand, the diameter of the front half part of the grip 500 is provided smaller than the diameter of the rear half part thereof, thus an unstable swing is caused. Especially, in the case of a beginner or intermediate golfer, when the state described above occurs, the hand is pushed back so that accuracy decreases and the driving distance is reduced.

SUMMARY

Accordingly, the present invention has been made keeping in mind the above problems occurring in the prior art, and an object of the present invention is to provide a grip for a golf club which is configured to allow thumbs of a user to be in close contact with the grip regardless of a shape of the grip when the user holds the grip, thereby allowing the user to maintain a stable posture when hitting a golf ball.

In order to accomplish the above object, the present invention provides a grip for a golf club, which includes: a concave part in which thumbs of the user are placed or inserted when the user grips the grip; at least one guide member provided on an inner surface of the concave part to guide positions and a gripping order of the thumbs of the user; and at least one anti-slip means provided on the inner surface of the concave part to prevent the thumbs from slipping.

The concave part may be provided with a thumb channel, which may have a semicircular cross-sectional shape and be formed along a longitudinal direction of the grip and on which the thumbs of the user are placed, and a depth h1 of the thumb channel may be provided by ⅓ to ½ of a thickness of the grip.

The concave part may be provided with a thumb channel, which may have a rectangular cross-sectional shape and be formed along a longitudinal direction of the grip and on which the thumbs of the user are placed, and a depth h1 of the thumb channel may be provided by ⅓ to ½ of a thickness of the grip.

The guide member may be shaped in the form of a wire or a strip, provided along a longitudinal direction of a center of the inner surface of the concave part, and made of a metal or synthetic resin material.

The anti-slip means may be configured as at least one of an unevenness, a protrusion, a groove, or an anti-slip rubber, and be provided where the thumbs of the user are placed.

A first part of the guide member defined in the longitudinal direction may be placed or inserted in the grip so that the thumbs of the user may be in close contact with a second part of the guide member.

The guide member may be a diameter of 1 mm to 3 mm, and is made of an aluminum material.

In addition, the grip for the golf club may further include: a cover part having a shape corresponding to a shape of the concave part, wherein, when the user does not use the golf club, the concave part may be covered with the cover part during movement or storage of the golf club.

In addition, the cover part may be provided with at least one fastening part for fastening the cover part and the grip together such that the cover part is detachable from the grip. Thus, the user may select between a method of gripping the grip by inserting or placing the thumbs in the concave part and a method of gripping the grip after covering the cover part on the concave part when swinging.

As described above, a grip for a golf club according to the present invention enables a user to maintain a stable gripping posture when the grip is gripped variously depending on various golf clubs such as a wood and a putter.

DETAILED DESCRIPTION

Figure 1:
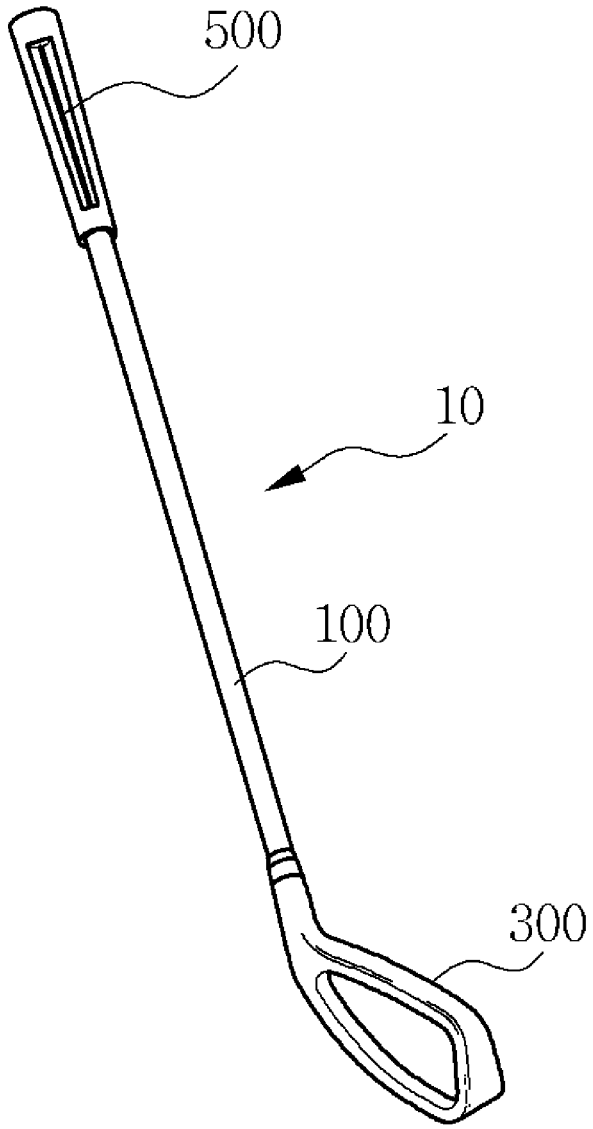
FIG. 1 is a perspective view showing a golf club according to the present invention.

As shown in FIG. 1, a grip for a golf club according to the present invention is provided at a second end of the golf club 10. That is, the golf club 10 includes a shaft 100 having a long stick shape and a head 300 connected to a first end of the shaft 100 for hitting a golf ball, and the grip 500 provided at a second end of the shaft 100 which is gripped by a user.

Figure 2:
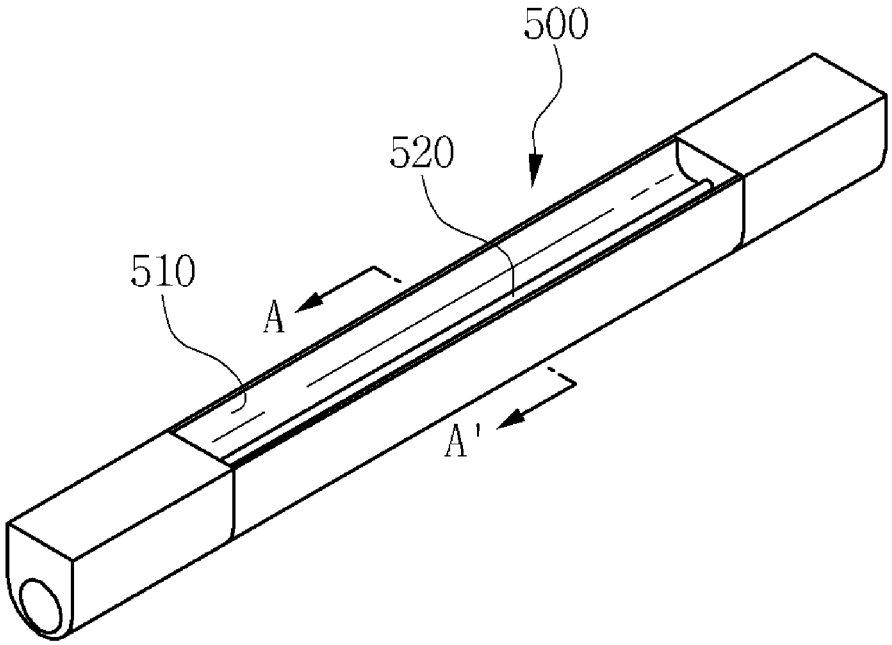
FIG. 2 is a perspective view showing a grip for the golf club according to the present invention.

As shown in FIG. 2, the grip 500 includes a concave part 510 in which thumbs of a user are placed or inserted when the user grips the grip 500, at least one guide member 520 provided on an inner surface of the concave part 510 to guide positions and a gripping order of the thumbs of the user, and at least one anti-slip means (not shown) provided on the inner surface of the concave part 510 to prevent slip.

The grip 500 has a circular cross-sectional shape, and the grip may be formed in a cylindrical shape having the same diameter at a first end and a second end of the cylindrical shape, or in a cylindrical shape having a tapered shape so that a diameter increases gradually from the first end to the second end thereof.

According to the present invention, the grip 500 is provided with the concave part 510 so that the user can swing while the thumbs are firmly close contact with the grip when the user grips it. That is, the thumbs of the user are placed or inserted in the concave part 510.

Hereinafter, the grip for the golf club according to exemplary embodiments of the present invention will be described in detail with reference to the accompanying drawings such that the invention can be easily embodied by one of ordinary skill in the art to which this invention belongs. The present invention is not limited to the following embodiments and various changes to the following embodiments are possible. In the following description, parts unrelated to the description will be omitted to clarify the present invention. Throughout the description, the same reference numerals will be used to refer to the same or like elements or parts.

The grip for the golf club according to the present invention is provided at the second end of the golf club 10 as shown in FIG. 1. That is, the golf club 10 includes the shaft 100 having the long stick shape the head 300 connected to the first end of the shaft 100 for hitting the golf ball, and the grip 500 provided at the second end of the shaft 100 for the user to grips.

As shown in FIG. 2, the grip 500 is provided with the concave part 510 in which the thumbs of the user are placed or inserted when the user grips the grip 500, at least one guide member 520 provided on the inner surface of the concave part 510 to guide the positions and the gripping order of the thumbs of the user, and at least one anti-slip means (not shown) provided on the inner surface of the concave part 510 to prevent slip.

The grip 500 has the circular cross-sectional shape, and may be formed in the cylindrical shape having the same diameter at the first end and the second end of the cylindrical shape, or in the cylindrical shape having the tapered shape so that the diameter increases gradually from the first end to the second end thereof.

The grip 500 according to the present invention is provided with the concave part 510 so that the user can swing while firmly contacting with the grip. That is, the thumbs of the user are placed or inserted in the concave part 510.

The concave part 510 may be provided with a thumb channel, which has a semicircular cross-sectional shape and is formed along a longitudinal direction of the grip 500 and on which the thumbs of the user are placed, and a depth h1 of the thumb channel is provided by ⅓ to ½ of a thickness of the grip 500.

Here, the depth h1 of the concave part 510 may be determined in consideration of swing tendency and posture of the user, a type of the golf club, and physical condition of the user. In addition, the depth h1 may be adjusted by a request of the user or may be manufactured sequentially with a predetermined difference so that the user can easily select it.

The concave part 510 may be provided with a thumb channel, which has a rectangular cross-sectional shape and formed along the longitudinal direction of the grip 500 and on which the thumbs of the user are placed, and a depth h1 of the thumb channel may be provided by ⅓ to ½ of the thickness of the grip 500.

Figure 5A:
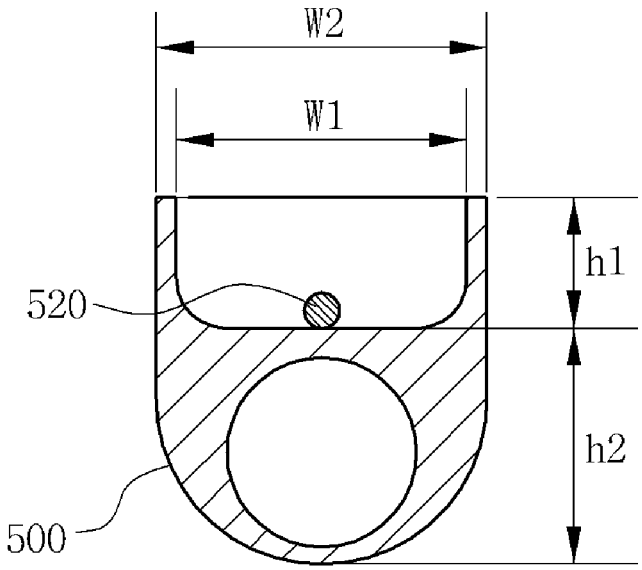
FIGS. 5*a* and 5*b* are cross-sectional views taken along an A-A' line of FIG. 2 showing the grip for the golf club according to various embodiments.
Figure 5B:
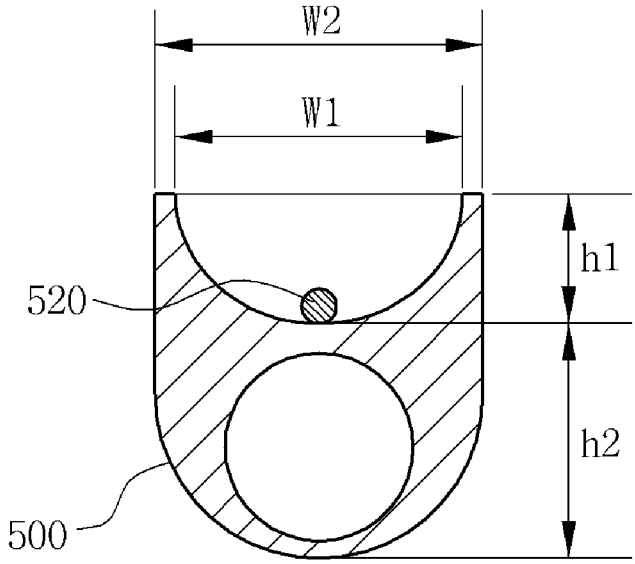

As described above, in the exemplary embodiments of the grip for the golf club according to the present invention, the concave part 510 may have the semicircular or rectangular cross-sectional shape as shown in FIGS. 5*a* and 5*b*, and may have various other shapes.

A width w1 of the concave part 510 may be determined in consideration of the swing tendency and the posture of the user, the type of the golf club, and the physical condition of the user. Generally, the width w1 may be provided less than a width w2 of the grip 500. As described above regarding the depth, the width w1 may be manufactured sequentially with the predetermined difference so that the user can easily select it.

In addition, since the concave part 510 provides a space in which the thumbs of the user are placed or inserted, the thumb channel may be formed in various shapes in addition to the shapes described above, and may change a size, diameter, cross-sectional shape depending on a variety of conditions and factors.

At least one guide member 520 is provided on the inner surface of the concave part 510. The guide member 520 is shaped in a shape of a wire or a strip, provided along a longitudinal direction of the center of the inner surface of the concave part 510, and formed of a metal or synthetic resin material.

The guide member 520 guides the positions of the thumbs when the user grips the grip 500, and may guide positions and an order of fingers when the user grips the grip 500. For example, the user can grip the grip 500 such that the guide member 520 is placed at the middle of each of the thumbs. In addition, the guide member 520 may perform an anti-slip function when swinging.

Figure 3:
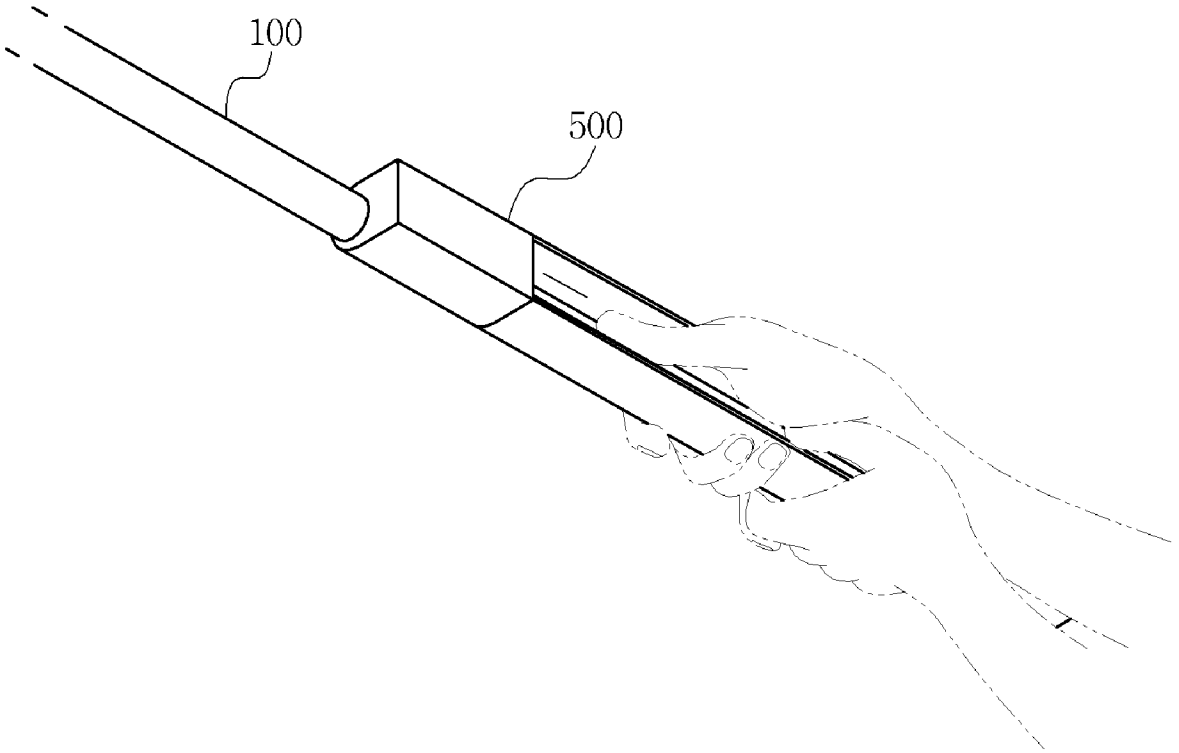
FIGS. 3 and 4 are views showing gripping methods of the grip for the golf club according to the present invention.
Figure 4:
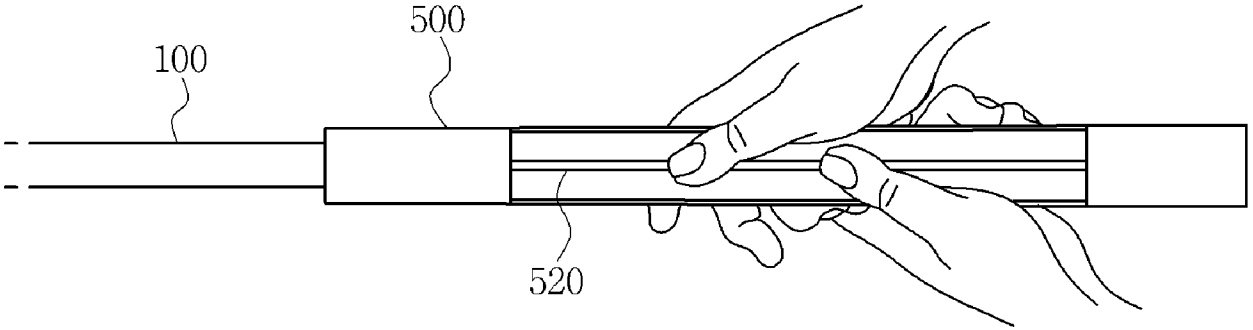

As shown in FIGS. 3 to 4, the user inserts the thumbs into the concave part 510 and places the thumbs to be in close contact with the guide member 520. The other order and positions of gripping are not significantly different from a swing posture using a general golf club, and it is a feature of the present invention that the thumbs of the user are in close contact with the concave part 510 or the guide member 520.

The guide member 520 may be shaped in the shape of the strip or the long wire as shown in the drawings, in some cases, a groove (now shown) or a placing space may be provided as a long shape on the inner surface of the concave part 510 of the grip 500 so that entire or a part of the guide member 520 may be inserted therein. That is, a sense of difference caused by the guide member 520 may be reduced when the user swings.

In other words, by inserting or placing a part of the guide member 520 defined in the longitudinal direction into the inner surface of the grip 500, the user can place the thumbs in close contact with a second part of the guide member 520.

The guide member 520 may have a diameter of 1 mm to 3 mm, and made of an aluminum material. Of course, various other materials such as wood, synthetic resin, and natural materials may be used in the guide member 520, and the diameter of the guide member 520 may be variously changed depending on cases.

In addition, the guide member 520 may be provided entirely along the longitudinal direction of the concave part 510, in some cases, it may be provided only where the thumbs are placed.

The guide member 520 may be attached to and detached from the grip 500 so that the user can optionally use the guide member. A plurality of guide members may be provided along a side surface of the concave part 510 in addition to along the center of the inner surface thereof.

On the inner surface of the concave part 510 or a side surface of the grip 500, at least one anti-slip means (not shown) is provided. The anti-slip means is made of at least one of an unevenness, a protrusion, a groove, or an anti-slip rubber, and may be provided where the thumbs of the user contact.

The grip for the golf club according to the present invention further includes a cover part (not shown) corresponding to a shape of the concave part 510. That is, by providing the cover part capable of filling the thumb channel that is a void space formed by the concave part 510, or covering the thumb channel, when the user does not use the golf club, the concave part is covered with the cover part during movement or storage of the golf club.

In addition, at least one fastening part for fastening the cover part and the grip 500 is provided to attach and detach the cover part to and from the grip 500. Accordingly, the user can select between a method of placing or inserting the thumbs in the concave part 510 and swinging the club and a method of gripping the grip 500 after covering the cover part and swinging the club.

As described above, the user examines various factors such as purpose, direction, and environment when swinging, and can select whether or not to swing by the golf club using the concave part 510 and the guide member 520 or to swing by using the general golf club.

The present invention described hereinabove is not limited to the described embodiments and the accompanying drawings, those skilled in the art will appreciate that various modifications, additions and substitutions are possible, without departing from the scope and spirit of the invention as disclosed in the accompanying claims.

The present invention can be used in the grip for the golf club capable of providing a stable posture when the user swings, by improving the structure of the grip.

The invention claimed is:

1. A grip for a golf club, the grip comprising:

a concave part in which thumbs of a user are to be placed or inserted when the user grips the grip;

at least one guide member provided on an inner surface of the concave part to guide positions and a gripping order of the thumbs of the user; and at least one anti-slip element provided on the inner surface of the concave part to prevent the thumbs from slipping, wherein the guide member is shaped in the form of a wire or a strip, provided along a longitudinal direction of a center of the inner surface of the concave part.

2. The grip of claim 1, wherein the concave part is provided with a thumb channel, which has a semicircular cross-sectional shape and is formed along a longitudinal direction of the grip and on which the thumbs of the user are to be placed, and a depth of the thumb channel is provided by ⅓ to ½ of a thickness of the grip.

3. The grip of claim 1, wherein the concave part is provided with a thumb channel, which has a rectangular cross-sectional shape and is formed along a longitudinal direction of the grip and on which the thumbs of the user are to be placed, and a depth of the thumb channel is provided by ⅓ to ½ of a thickness of the grip.

4. The grip of claim 1, wherein the guide member is made of a metal or synthetic resin material.

5. The grip of claim 1, wherein the anti-slip element has one selected from the group consisting of an unevenness, a protrusion, a groove, an anti-slip rubber, and a combination thereof to prevent, and the anti-slip element is provided where the thumbs of the user are placed.

6. The grip of claim 1, wherein a first part of the guide member defined in the longitudinal direction is placed or inserted in the grip so that the thumbs of the user are in close contact with a second part of the guide member.

7. The grip of claim 1, wherein the guide member has a diameter of 1 mm to 3 mm, and is made of an aluminum material.

8. The grip of claim 1, further comprising: a cover part having a shape corresponding to a shape of the concave part, wherein, when the user does not use the golf club, the concave part is covered with the cover part during movement or storage of the golf club.

9. The grip of claim 8, wherein the cover part is provided with at least one fastening part for fastening the cover part and the grip together such that the cover part is detachable from the grip, thus the user selects between a method of gripping the grip by inserting or placing the thumbs in the concave part and a method of gripping the grip after covering the cover part on the concave part when swinging.

10. A shaft for a golf club, the shaft having the grip of claim 1.

11. A golf club comprising a shaft, a club head provided at one end of the shaft, and the grip of claim 1 provided at the other end of the shaft.

* * * * *